US006866266B1

(12) United States Patent
Thorne

(10) Patent No.: US 6,866,266 B1
(45) Date of Patent: Mar. 15, 2005

(54) GAME SYSTEM AND METHOD OF PLAYING A GAME

(76) Inventor: Gary Thorne, 4044 Winfield Ter., Easton, PA (US) 18045

( * ) Notice: Subject to any disclaimer, the term of this patent is extended or adjusted under 35 U.S.C. 154(b) by 0 days.

(21) Appl. No.: 10/638,169

(22) Filed: Aug. 8, 2003

(51) Int. Cl.[7] ..... A63F 3/06
(52) U.S. Cl. ..... 273/271; 273/288; 273/291
(58) Field of Search ..... 273/248, 258, 273/268, 271, 288, 290, 291

(56) References Cited

U.S. PATENT DOCUMENTS 3,506,267 A * 4/1970 Taillie ..... 273/275
3,747,926 A * 7/1973 Odom ..... 273/271
3,917,272 A * 11/1975 Aldea ..... 273/260
4,147,361 A * 4/1979 Imatt ..... 273/271
4,171,814 A * 10/1979 Tamano ..... 273/243
4,254,957 A * 3/1981 Kramer ..... 273/271
4,541,634 A * 9/1985 Nolan ..... 273/271
4,580,787 A 4/1986 Baker
4,673,185 A 6/1987 Morley, Jr.
4,902,021 A 2/1990 Burroughs
4,938,472 A * 7/1990 Gould et al. ..... 273/241
5,324,040 A * 6/1994 Panda ..... 273/272
5,344,153 A * 9/1994 Watanabe ..... 273/271
5,433,448 A * 7/1995 Raphael et al. ..... 273/241
6,655,687 B2 * 12/2003 Sanchez-Seco ..... 273/271

* cited by examiner

*Primary Examiner*—Kurt Fernstrom

(57) ABSTRACT

A game system and method of playing a game for providing amusement for a plurality of players. The game system includes a plurality of game tokens is designed for being selectively placed on a support surface. The game tokens comprise a plurality of sets of game tokens whereby each of the sets of game tokens is designed for representing one of a plurality of players. Each of the game tokens comprises plurality of side faces whereby at least one of the side faces of one of the game tokens abuts one of the side faces of an adjacent one of the game tokens when the associated one of the game tokens is placed on the support surface.

11 Claims, 2 Drawing Sheets

GAME SYSTEM AND METHOD OF PLAYING A GAME

BACKGROUND OF THE INVENTION

1. Field of the Invention

The present invention relates to board games and more particularly pertains to a new game system and method of playing a game for providing amusement for a plurality of players.

2. Description of the Prior Art

The use of board games is known in the prior art. U.S. Pat. No. 4,580,787 describes a device for playing a game having a game board with a plurality of hexagonal colored spaces. Another type of board game is U.S. Pat. No. 4,902,021 having a modified checker board for playing a checker and dice game. U.S. Pat. No. 4,673,185 has a plurality of hexagonal tiles that are placed on a surface so that patterns on the tiles matches patterns on adjoining tiles.

While these devices fulfill their respective, particular objectives and requirements, the need remains for a system that has certain improved features that allows players to play a game using tiles and strategy.

SUMMARY OF THE INVENTION

The present invention meets the needs presented above by providing each of players with a plurality game tokens and allowing the players to place their game tokens on the support surface to attempt to link five game tokens in a straight line.

Still yet another object of the present invention is to provide a new game system and method of playing a game that allows the players further the amusement by scoring points for winning.

To this end, the present invention generally comprises a plurality of game tokens is designed for being selectively placed on a support surface. The game tokens comprise a plurality of sets of game tokens whereby each of the sets of game tokens is designed for representing one of a plurality of players. Each of the game tokens comprises plurality of side faces whereby at least one of the side faces of one of the game tokens abuts one of the side faces of an adjacent one of the game tokens when the associated one of the game tokens is placed on the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
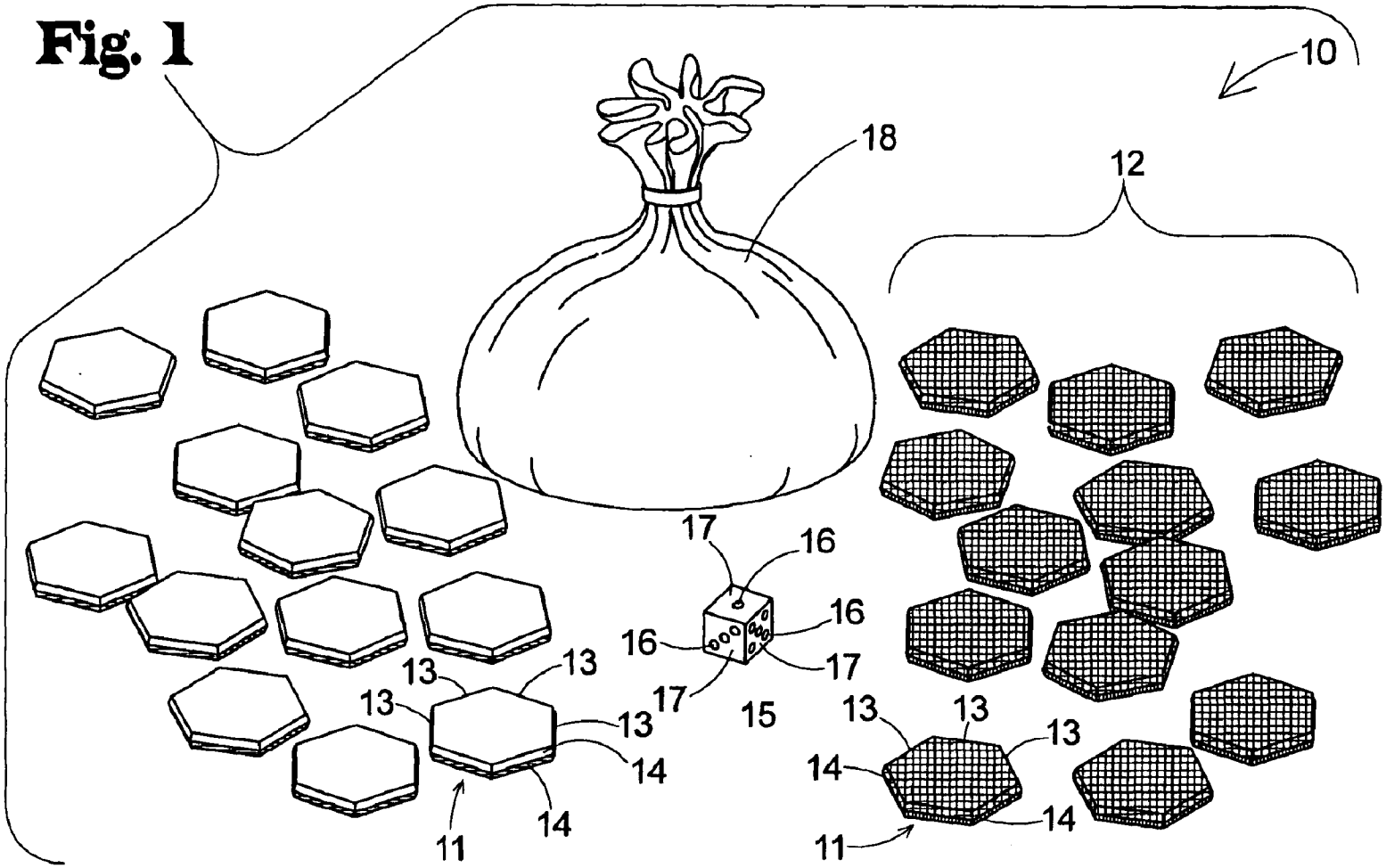
FIG. 1 is a perspective view of a new game system according to the present invention.
Figure 2:
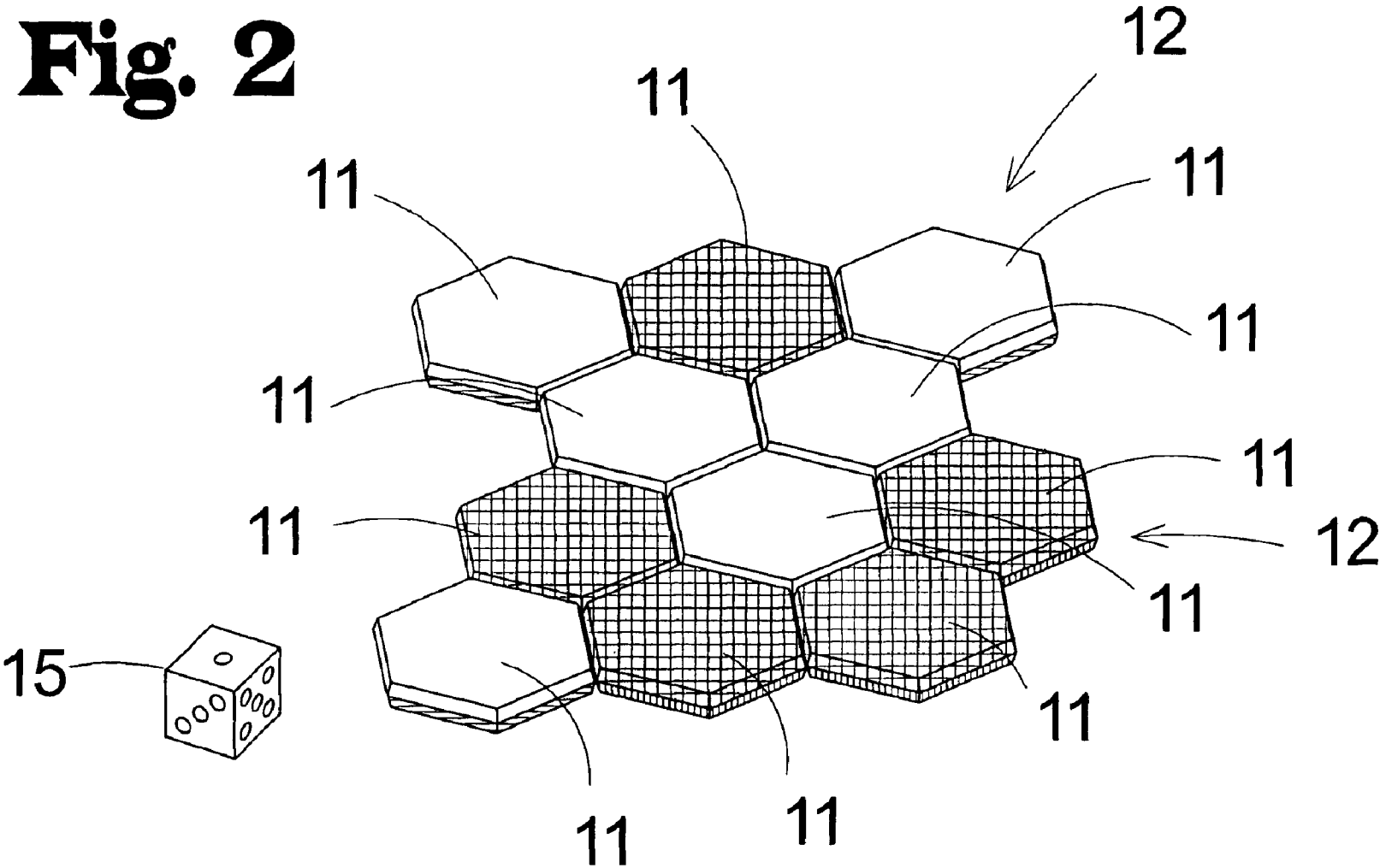
FIG. 2 is a perspective view of a plurality of game tokens of the present invention that have been placed on the support surface.

With reference now to the drawings, and in particular to FIGS. 1 and 2 thereof, a new game system and method of playing a game embodying the principles and concepts of the present invention and generally designated by the reference numeral 10 will be described.

As best illustrated in FIGS. 1 and 2, the game system 10 generally comprises a plurality of game tokens 11 is designed for being selectively placed on a support surface. The game tokens 11 comprise a plurality of sets of game tokens 12 whereby each of the sets of game tokens 12 is designed for representing one of a plurality of players. Each of the game tokens 11 comprises plurality of side faces 13 whereby at least one of the side faces 13 of one of the game tokens 11 abuts one of the side faces 13 of an adjacent one of the game tokens 11 when the associated one of the game tokens 11 is placed on the support surface.

Each of the game tokens 11 of each of the sets of game tokens 12 comprises a plurality of indicating sides 14. Each of the indicating sides 14 of each of the game tokens 11 of each of the sets of game tokens 12 is uniquely colored whereby each of the indicating sides 14 of the game tokens 11 of each of the sets of game tokens 12 is colored differently from the other of the indicating sides 14 of the game tokens 11 of the other of the sets of game tokens 12. The indicating sides 14 of the game tokens 11 of each of the sets of game tokens 12 is designed for representing one of the players.

At least one die 15 comprises a plurality of number faces 16. Each of the number faces 16 of the die 15 comprises a unique number indicia 17 whereby the number indicia 17 of one of the number faces 16 is designed for determining which one of the players is to play first when the die 15 is rolled by the players.

A storage member 18 selectively receives the game tokens 11 and the die 15. The storage member 18 is for storing the game tokens 11 and the die 15 when the game tokens 11 and the die 15 are not being used by the players.

In use, the game tokens 11 and the die 15 are removed from the storage member 18. One of the indicating sides 14 of the game tokens 11 of one of the sets of game tokens 12 is chosen by each of the players to represent the associated one of the players. A predetermined starting number of game tokens 11 from the associated one of the sets of game tokens 12 is provided to the associated one of the players. The die 15 is rolled by each of the players in turn to determine which of the players goes first. One of the game tokens 11 from the associated one of the sets of game tokens 12 is placed on the support surface by the one of players determined to go first. One of the game tokens 11 being placing on the support surface by each of the players in turn whereby the associated one of the game tokens 11 abuts at least two of the game tokens 11 positioned on the support surface when at least two game tokens 11 have been place on the support surface. One of the game tokens 11 being placed by the associated one the players against one of the game tokens 11 positioned on the support surface when the associated one the players is blocking an opposing one of the players from winning the game. One of the game tokens 11 being placed by the associated one the players against one of the game tokens 11 positioned on the support surface when the associated one the players is placing the last of the predetermined number of game tokens 11 in a straight line to win the game. One of the game tokens 11 is removed from the support surface and repositioned on the support surface by the associated one of the players when the associated one of the player has placed all of the game tokens 11 from the associated one of the sets of game tokens 12 on the support surface. One of the players wins the game when the associated one of the players has placed a predetermined number of the game tokens 11 from the associated one of the sets of game tokens 12 representing the associated one of the players on the support surface in a straight line. In an alternate, a number of points equal to the highest valued one of the number indicia 17 indicated by the players rolling the die 15 is scored by the associated one of the players when the associated one of the players wins the game. The amount of points scored by the player is doubled when the die 15 is rolled a second time when at least two of the highest value of the number indicia 17 rolled by the players was rolled by at least two players. The player with the highest number of points after a predetermined number of games wins.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Further, virtual versions of game system are also considered to fall within the scope of this present invention. The virtual versions may be accomplished through software, firmware, or hard coding with a variety input and output solutions to provide entertainment for the user. The virtual versions of the game system adhere to the same method of play as in the non-virtual game system.

I claim:

1. A game system comprising:

a plurality of game tokens being adapted for being selectively placed on a support surface, said game tokens comprising a plurality of sets of game tokens such that each of said sets of game tokens is adapted for representing one of a plurality of players, each of said game tokens comprising plurality of side faces such that at least one of said side faces of one of said game tokens abuts one of said side faces of an adjacent one of said game tokens when the associated one of said game tokens is placed on the support surface; and each of said game tokens of each of said sets of game tokens comprising a plurality of indicating sides, each of said indicating sides of each of said game tokens of each of said sets of game tokens being uniquely colored such that each of said indicating sides of said game tokens of each of said sets of game tokens is colored differently from the other of said indicating sides of said game tokens of the other of said sets of game tokens, said indicating sides of said game tokens of each of said sets of game tokens being adapted for representing one of the players.

2. The game system as set forth in claim 1, further comprising:

at least one die comprising a plurality of number faces, each of said number faces of said die comprising a unique number indicia such that said number indicia of one of said number faces is adapted for determining which one of the players is to play first when said die is rolled by the players.

3. The game system as set forth in claim 1, further comprising:

a storage member selectively receiving said game tokens, said storage member being for storing said game tokens when said game tokens are not being used by the players.

4. A method of playing a game comprising:

a game system comprising:

a plurality of game tokens being adapted for being selectively placed on a support surface, said game tokens comprising a plurality of sets of game tokens such that each of said sets of game tokens is adapted for representing one of a plurality of players, each of said game tokens comprising plurality of side faces such that at least one of said side faces of one of said game tokens abuts one of said side faces of an adjacent one of said game tokens when the associated one of said game tokens is placed on the support surface;

each of said game tokens of each of said sets of game tokens comprising a plurality of indicating sides, each of said indicating sides of each of said game tokens of each of said sets of game tokens being uniquely colored such that each of said indicating sides of said game tokens of each of said sets of game tokens is colored differently from the other of said indicating sides of said game tokens of the other of said sets of game tokens, said indicating sides of said game tokens of each of said sets of game tokens being adapted for representing one of the players;

at least one die comprising a plurality of number faces, each of said number faces of said die comprising a unique number indicia such that said number indicia of one of said number faces is adapted for determining which one of the players is to play first when said die is rolled by the players;

a storage member selectively receiving said game tokens and said die, said storage member being for storing said game tokens and said die when said game tokens and said doe are not being used by the players;

removing said game tokens and said die from said storage member;

selecting of one of said indicating sides of said game tokens of one of said sets of game tokens by each of the players to represent the associated one of the players;

rolling of said die by each of the players in turn to determine which of the players goes first;

placing of one of said game tokens from the associated one of said sets of game tokens on the support surface by the one of players determined to go first;

placing one of said game tokens from the associated one of said set of game tokens by each of the players in turn such that one of said side faces of the associated one of said game tokens abuts one of said side faces at least one of said game tokens previously placed on the support surface; and winning of the game when one of the players has placed a predetermined number of said game tokens from the associated one of said sets of game tokens representing the associated one of the players on the support surface in a straight line.

5. The method as set forth in claim 4, further comprising:

providing a predetermined starting number of game tokens from the associated one of said sets of game tokens to the associated one of the players.

6. The method as set forth in claim 4, further comprising:

removing one of said game tokens from the support surface and repositioning the associated one of said game tokens on the support surface by the associated one of the players when the associated one of the player has placed all of said game tokens from the associated one of said sets of game tokens on the support surface.

7. The method as set forth in claim 4, further comprising:

scoring of number of points equal to the highest valued one of said number indicia indicated by the players rolling said die when the associated one of the players wins the game.

8. The method as set forth in claim 7, further comprising:

doubling of the amount of points scored by the player when said die is rolled a second time when at least two of the highest value of said number indicia rolled by the players was rolled by at least two players.

9. The method as set forth in claim 4, further comprising:

placing of one of said game tokens by each of the players in turn such that the associated one of said game tokens abuts at least two of said game tokens positioned on the support surface when at least two game tokens have been place on the support surface.

10. The method as set forth in claim 9, further comprising:

placing of one of said game tokens by the associated one the players against one of said game tokens positioned on the support surface when the associated one the players is blocking an opposing one of the players from winning the game.

11. The method as set forth in claim 10, further comprising:

placing of one of said game tokens by the associated one the players against one of said game tokens positioned on the support surface when the associated one the players is placing the last of the predetermined number of game tokens in a straight line to win the game.

* * * * *